US006318475B1

(12) United States Patent
Seragnoli

(10) Patent No.: US 6,318,475 B1
(45) **Date of Patent: *Nov. 20, 2001**

(54) FLAMES AND FUMES STOPPING DEVICE FOR SUCTION DUCTS

(75) Inventor: Giordano Seragnoli, Agrate Brianza (IT)

(73) Assignee: STMicroelectronics S.r.l., Agrate Brianza (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/237,215

(22) Filed: Jan. 25, 1999

(30) Foreign Application Priority Data

Feb. 11, 1998 (EP) ..... 98830060

(51) Int. Cl.[7] ..... A62C 37/10
(52) U.S. Cl. ..... 169/61; 169/19; 169/54
(58) Field of Search ..... 169/19, 54, 56, 169/60, 61, 57, 58; 239/63, 65

(56) References Cited

U.S. PATENT DOCUMENTS

| | | | | |
|---|---|---|---|---|
| 2,382,120 | * | 8/1945 | White | 169/57 |
| 2,571,961 | * | 10/1951 | Smith . | |
| 2,988,150 | * | 6/1961 | Smith . | |
| 3,488,170 | * | 1/1970 | Smith . | |
| 3,592,207 | * | 7/1971 | Borello . | |
| 3,645,337 | * | 2/1972 | Livingston | 169/61 |
| 4,143,670 | * | 3/1979 | Olson et al. | 169/56 |
| 4,519,458 | | 5/1985 | Kroeter | 169/56 |
| 4,545,528 | * | 10/1985 | Perez | 239/65 |
| 4,984,637 | * | 1/1991 | Finnigan | 169/61 |

FOREIGN PATENT DOCUMENTS

| | | | |
|---|---|---|---|
| 173185 | 12/1933 | (CH) . | |
| 41 26 932 A1 | 2/1993 | (DE) | A62C/4/02 |
| 0 559 968 A1 | 12/1992 | (EP) | A62C/3/04 |
| 0 353 840 A1 | 5/1989 | (EP) | F23G/7/06 |
| 556-818 * | 9/1977 | (SU) | 169/56 |

* cited by examiner

*Primary Examiner*—David A. Scherbel
*Assistant Examiner*—Christopher S. Kim
(74) *Attorney, Agent, or Firm*—Theodore E. Galanthay; Allen, Dyer, Doppelt, Milbrath & Gilchrist, P.A.

(57) ABSTRACT

A flame and fume stopping device for a suction duct that removes gaseous mixtures from a room includes a normally-empty inverted siphon in the suction duct. A water tank is connected to the inverted siphon by a gravity discharge pipe, and holds a volume of water sufficient for flooding the inverted siphon. The water tank is at a level higher than the inverted siphon. The gravity discharge pipe includes a solenoid valve for discharging the water into the siphon. A sensor for determining the temperature of the gaseous mixture passing through the suction duct generates an electrical command signal that triggers the opening of the solenoid valve when a certain temperature threshold is exceeded.

17 Claims, 3 Drawing Sheets

FLAMES AND FUMES STOPPING DEVICE FOR SUCTION DUCTS

FIELD OF THE INVENTION

The present invention relates to the field of air scrubbers, and, more particularly, to a fire extinguishing system for a centralized gas and vapor collection system.

BACKGROUND OF THE INVENTION

In laboratories and industrial plants where smoke and fumes may be produced during certain steps of a fabrication process, it is necessary to filter noxious gases and fumes from the air to prevent atmospheric pollution. Such an operation is carried out by specifically designed scrubbing systems, also referred to as scrubbers. Scrubbers purify the gases collected at the various locations where smoke, fumes or other polluting gaseous substances are released. Due to the large investment needed for obtaining efficient scrubbing systems, it is a common practice to select a centralized scrubbing system where suction ducts convey the gas-air mixture. This is particularly applicable when there are numerous locations releasing substances in need of being filtered, as depicted in FIGS. 1*a* and 1*b*.

Collection systems include suction ducts that interconnect different suction locations through a branch-like or star-like conduit structure, as shown in FIGS. 1*a*, 1*b* and 2. Similar suction systems for recirculation are also present in centralized air-conditioning installations to draw the air from the rooms and provide it to a purification and conditioning station. The suction ducts are often installed on the roofs of buildings, and consequently, they are exposed to intense solar irradiation and other atmospheric agents that may damage the suction ducts through prolonged exposure. It is common practice to use fiber glass reinforced resin pipes or similar corrosion and heat resistant materials capable of resisting attack from chemical substances that may eventually be released in the gaseous mixture conveyed through the suction ducts.

If a fire develops in an air suction area, the flames may reach other suction areas through the collecting conduits that join at the nearest node of the suction system. Furthermore, spreading of the fire may even be aided by the automatic switching off of the suction system. This feature is commonly implemented at scrubbing plants to meet safety rules in case of a fire.

SUMMARY OF THE INVENTION

The present invention provides an effective device for preventing a fire from spreading through suction ducts that convey smoke, fumes or other gaseous mixtures generated in certain working areas. The flame and fume stopping device of the invention is simple to implement and is reliable and effective in its operation.

According to the invention, an effective flame and fume stopping device for a suction duct that conveys gaseous mixtures from a working area or room comprises a normally empty goose neck portion installed along the suction duct. The goose neck portion is installed as close as possible to the suction inlet. A water tank large enough to hold a volume of water sufficient to flood the goose neck is also provided. The water tank is positioned at a level higher than the goose neck portion of the suction duct and has a gravity discharge pipe operated by a solenoid valve. A solenoid valve is used for releasing the water into the siphon. A heat detector triggers an electric command for the solenoid valve when the temperature of the gaseous mixture exceeds a certain threshold.

The device of the invention operates like a fuse by blocking the suction conduit to stop spreading of the fire therethrough. A fuse-like flame and fume stopping device of the invention may be installed along each suction duct in any room. Installation is preferably as close as possible to the suction inlet where smoke and fumes are likely to originate.

Activation of the device by an isolated fire prevents spreading of the smoke and flames through the suction duct, even when the centralized system continues to operate. However, operation of the flame and fume stopping device is bidirectional. That is, operation of the flame and fume stopping device is ensured whether the fire originates at the inlet point of the suction duct, or if the fire is reaching the device through the suction duct from the centralized scrubbing station.

BRIEF DESCRIPTION OF THE FIGURES

The various aspects and advantages of the invention will become even more evident through the following description of an embodiment and by referring to the enclosed figures, wherein.

DETAILED DESCRIPTION OF THE PREFERRED EMBODIMENTS

Figure 2:
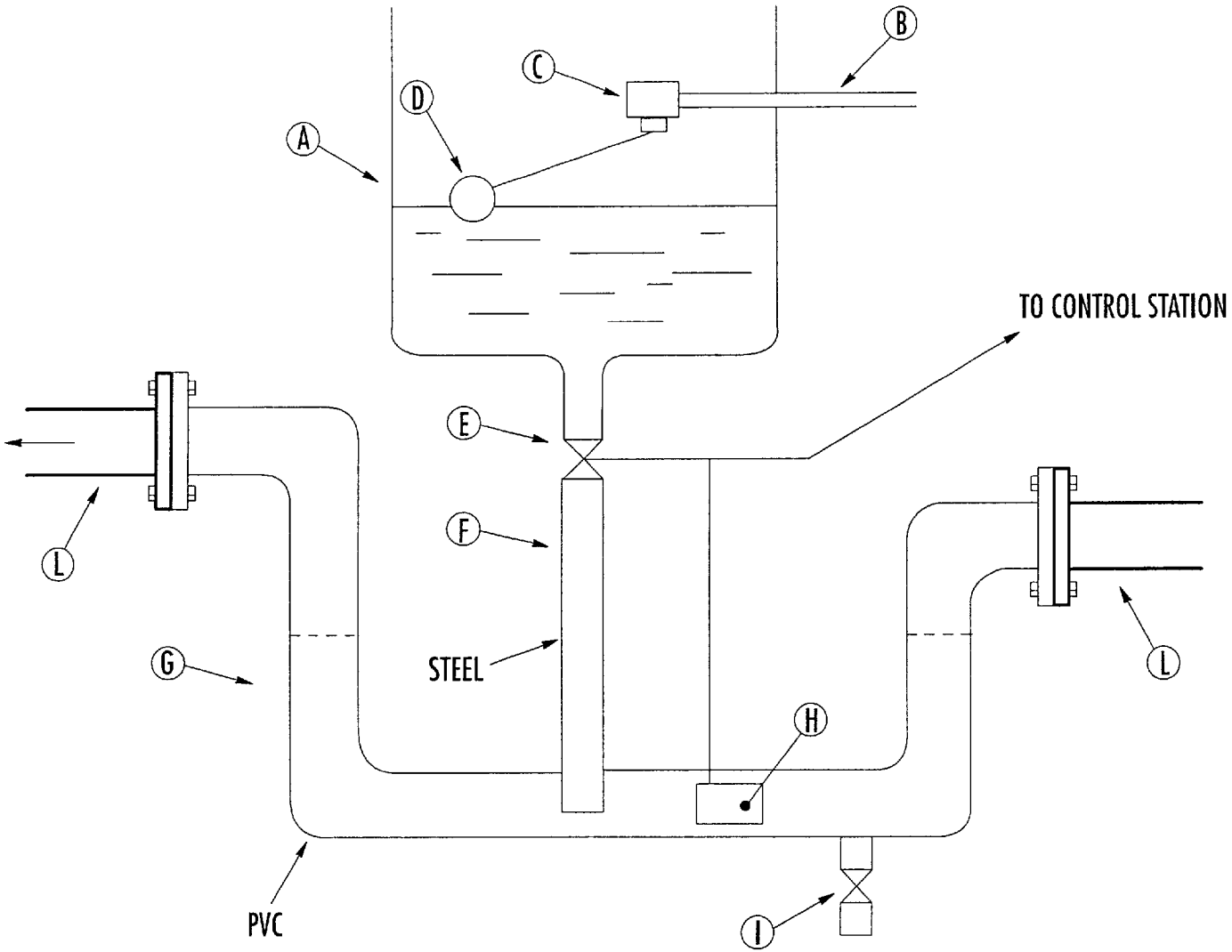
FIG. 2 is a scheme of a flame and fume stopping device, according to the present invention.

By referring to FIG. 2, the flame and fume stopping device acts as a fuse. The device comprises an inverted or goose neck siphon G inserted along a suction duct L of an air and/or gases and fumes collection and scrubbing system. The inverted siphon G in the duct path does not materially affect pressure losses of the suction system because the dimensions of the siphon G can be varied accordingly.

Preferably, the inverted siphon G is made of a material that melts or collapses at high temperatures, such as the temperatures reached by the flames themselves. The material is also corrosion resistant and does not ignite. For example, in an external installation, the inverted siphon G may be made of PVC loaded with carbon black or other inert substances capable of providing an adequate resistance to aging and solar radiation. Of course, other equivalent materials can be used. Because of the relatively low cost of such "U" shaped ducting sections that form the inverted siphon G, these sections may be replaced periodically if inspections indicates excessive aging and wear.

The device of the invention also comprises a water tank A capable of holding a volume of water sufficient to flood the lower part of the inverted siphon G, which acts as a water trap. The tank A is installed at a higher level than the level of the siphon G and has a gravity discharge pipe F. The gravity discharge pipe F includes a solenoid valve for discharging the water into the bottom part of the inverted siphon G. The water tank A, the discharge pipe F leading into the water trap siphon G, and the solenoid valve E are all preferably made of metal or a flame resistant material.

The tank A is commonly equipped with a float D forming a float valve C to maintain an adequate volume of water in the tank through the water supply pipe B. The float valve C maintains a constant level of water which compensates for evaporation losses that may especially occur in the hot season. A temperature sensor H responsive to the gaseous mixture flowing in the suction duct triggers the opening of the solenoid valve E if the temperature exceeds a certain temperature threshold. Therefore, the temperature sensor H intervenes whenever a fire overheats the gases passing through the suction duct L. The opening of the solenoid valve E releases the water from the tank A which floods the water trap formed by the inverted siphon G.

The flooding of the siphon G interrupts the air flow through the suction duct L, thus avoiding the risk of spreading a fire therethrough. The flames are blocked through the suction duct L by the water trapped in the lower part of the siphon G. Eventually, if the flames reach the siphon, they will melt or cause the collapse of the material which forms the U shaped siphon. Consequently, this provides a physical interruption of the suction duct L.

A manually operated discharge valve I allows for periodic checks on the operation of the flame and fume stopping device. Preferably, as shown in FIG. 2, the temperature sensor H, which, for example, may include a thermocouple, generates an electric signal. The electrical signal may also be useful for monitoring purposes besides being used for triggering the opening of the solenoid valve E when a certain threshold temperature is exceeded. The temperature signal may be applied to a centralized monitoring system that is programmed to automatically stop the suction system when abnormal conditions occur and to activate an alarm. Both the temperature sensor H and the solenoid valve E rely on uninterrupted electrical supply even during power interruptions. Accordingly, they will generally be supplied through emergency supply lines.

Figure 1B:
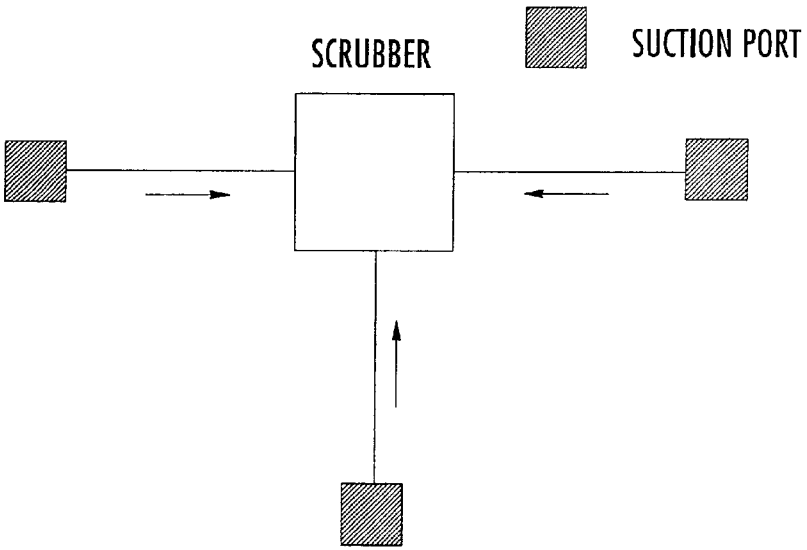
FIG. 1b. (PRIOR ART)
FIGS. 1*a* and 1*b* show exemplary layouts of centralized gas collecting systems, according to the prior art.
Figure 1A:
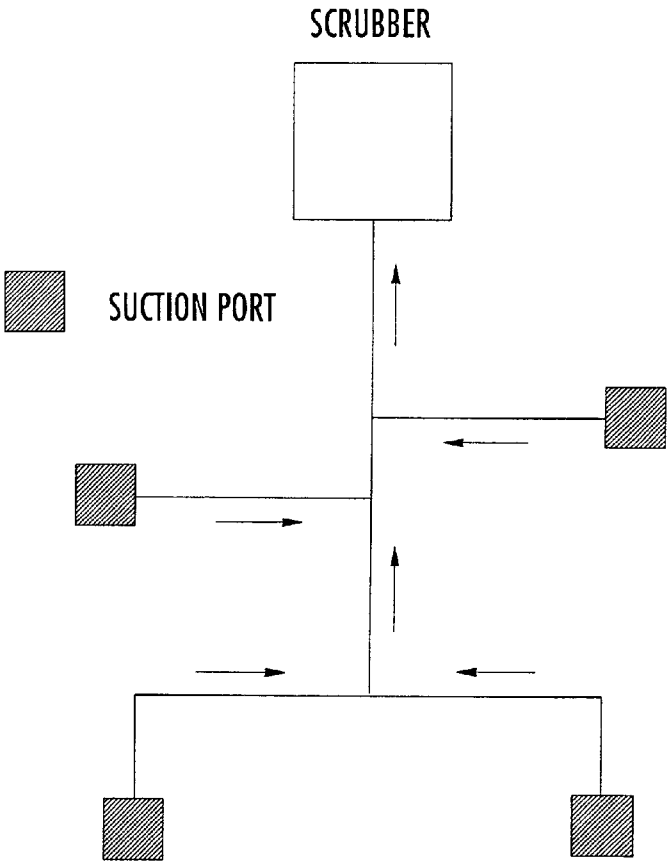
FIG. 1a. (PRIOR ART)
Figure 3B:
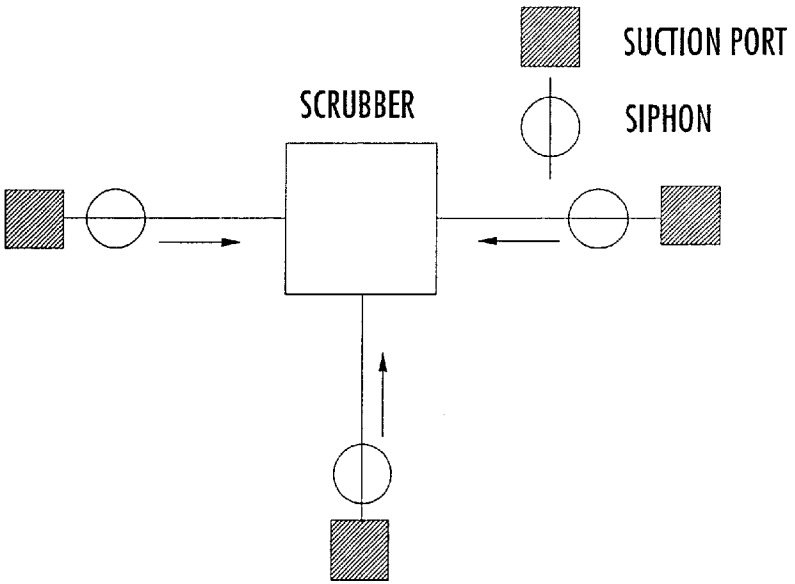
FIGS. 3*a* and 3*b* reproduce the schemes of FIGS. 1*a* and 1*b* showing the positioning of the flame and fume stopping devices, according to the present invention.
Figure 3A:
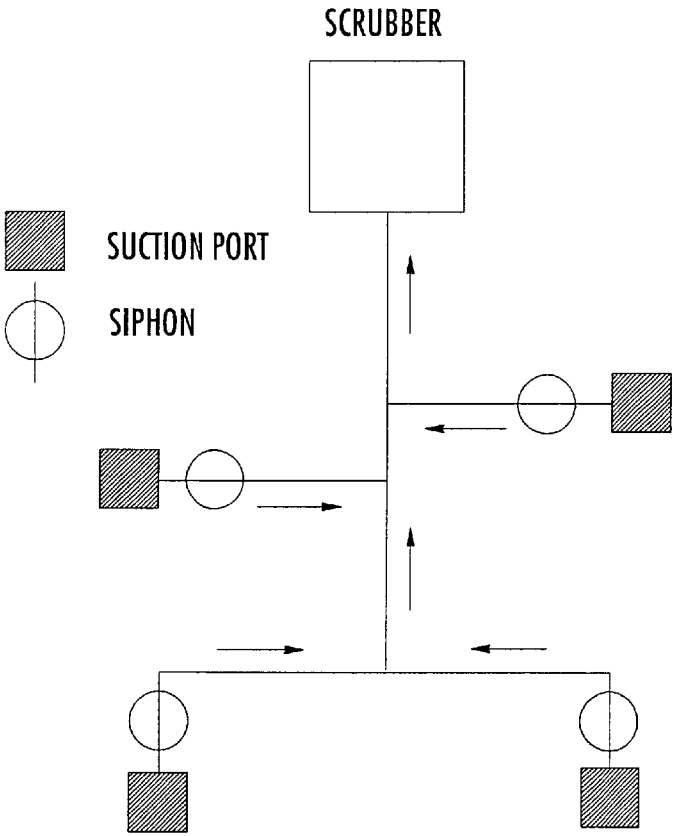

FIGS. 3*a* and 3*b* reproduce the schemes of the collecting systems of FIGS. 1*a* and 1*b,* and indicate the locations at which the flame and fume stopping devices of the present invention should be preferably installed. The location of the flame and fume stopping device in relation to a centralized collecting and scrubbing system is suggestive of how the invention can also effectively be used to block the suction of air from intakes in a certain room having a fire within. This prevents the spread of fires through the air recirculation ducts that may originate in a particular room.

That which is claimed is:

1. A flame and fume stopping device for a conduit comprising:

an inverted siphon interposed with the conduit, said inverted siphon having a tubular shape and being devoid of material therein in an unflooded state;

a tank for holding a volume of liquid sufficient to flood said inverted siphon;

connecting means for connecting said tank to said inverted siphon;

a valve connected to said connecting means for discharging the liquid into said inverted siphon for flooding thereof;

a sensor for sensing temperature of a gaseous mixture passing through the conduit and activating said valve to discharge the liquid when a predetermined temperature threshold is exceeded; and a discharge valve connected to said inverted siphon for releasing the liquid after said inverted siphon has been flooded so that the inverted siphon is returned again to the unflooded state devoid of material therein for reuse.

2. A flame and fume stopping device according to claim 1, wherein said inverted siphon comprises a material that collapses in proximity to a fire.

3. A flame and fume stopping device according to claim 1, wherein said inverted siphon comprises a material that melts in proximity to a fire.

4. A flame and fume stopping device according to claim 1, further comprising a float valve in said tank for maintaining a predetermined level therein.

5. A flame and fume stopping device according to claim 1, wherein said tank is at a level higher than said inverted siphon.

6. A flame and fume stopping device according to claim 5, wherein said connecting means comprises a gravity discharge pipe connecting said tank to said inverted siphon.

7. A flame and fume stopping device according to claim 6, wherein said valve comprises a solenoid valve.

8. A flame and fume stopping device for a conduit that removes a gaseous mixture from a room, the device comprising:

an inverted siphon interposed with the conduit, said inverted siphon having a tubular shape and being devoid of material therein in an unflooded state;

a water tank at a level higher than said inverted siphon for holding a volume of water sufficient to flood said inverted siphon;

a gravity discharge pipe connecting said water tank to said inverted siphon;

a solenoid valve interposed with said gravity discharge pipe for discharging the water into said inverted siphon for flooding thereof;

a sensor for sensing temperature of the gaseous mixture passing through the conduit and generating an electrical command signal causing said solenoid valve to discharge the water when a predetermined temperature threshold is exceeded; and a discharge valve connected to said inverted siphon for releasing the water after said inverted siphon has been flooded so that the inverted siphon is returned again to the unflooded state devoid of material therein for reuse.

9. A flame and fume stopping device according to claim 8, wherein said inverted siphon comprises a material that collapses in proximity to a fire.

10. A flame and fume stopping device according to claim 8, wherein said inverted siphon comprises a material that melts in proximity to a fire.

11. A flame and fume stopping device according to claim 8, further comprising a float valve in said water tank for maintaining a predetermined level therein.

12. A method for stopping flames and fumes in a conduit that removes gaseous mixtures, the method comprising the steps of:

sensing temperature of a gaseous mixture passing through the conduit;

generating an electrical command signal for activating a solenoid valve when a predetermined temperature threshold is exceeded for flooding an inverted siphon interposed with the conduit with a liquid, the inverted siphon having a tubular shape and being devoid of material therein in an unflooded state; and releasing the liquid after said inverted siphon has been flooded using a discharge valve connected to the inverted siphon so that the inverted siphon is returned again to the unflooded state devoid of material therein for reuse.

13. A method according to claim 12, further comprising the step of storing the liquid in a tank at a level higher than the inverted siphon.

14. A method according to claim 13, further comprising connecting the water tank to the inverted siphon with a gravity discharge pipe.

15. A method according to claim 12, wherein the inverted siphon comprises a material that collapses in proximity to a fire.

16. A method according to claim 12, wherein the inverted siphon comprises a material that melts in proximity to a fire.

17. A method according to claim 12, further comprising maintaining a predetermined level in the tank using a float valve.

* * * * *